US006871377B2

(12) United States Patent
Veltrop et al.

(10) Patent No.: US 6,871,377 B2
(45) Date of Patent: Mar. 29, 2005

(54) GRILL SCRAPER

(75) Inventors: Loren J. Veltrop, Deerfield, IL (US); Lawrence G. Banovez, Kenoshi, WI (US); Edward T. Eaton, Wheaton, IL (US)

(73) Assignee: Prince Castle Inc., Carol Stream, IL (US)

( * ) Notice: Subject to any disclaimer, the term of this patent is extended or adjusted under 35 U.S.C. 154(b) by 415 days.

(21) Appl. No.: 10/051,526

(22) Filed: Jan. 18, 2002

(65) Prior Publication Data

US 2004/0148727 A1 Aug. 5, 2004

(51) Int. Cl.[7] ..... A47L 13/022; A47L 13/08

(52) U.S. Cl. ..... 15/236.01; 15/143.1; 30/169; D32/48; D32/49

(58) Field of Search ..... 15/143.1, 236.01; 30/169; D32/46, 48, 49

(56) References Cited

U.S. PATENT DOCUMENTS

| | | | | | |
|---|---|---|---|---|---|
| 713,979 | A | * | 11/1902 | Galipeau | 30/171 |
| 1,145,966 | A | * | 7/1915 | Bergmann | 15/104.04 |
| 1,412,728 | A | * | 4/1922 | Werner | 30/169 |
| 1,523,579 | A | * | 1/1925 | Brower | 30/169 |
| 2,392,273 | A | * | 1/1946 | Soldani | 30/171 |
| 2,556,797 | A | * | 6/1951 | Carlson | 15/236.01 |
| 3,173,206 | A | * | 3/1965 | Chambers | 30/169 |
| 3,195,232 | A | * | 7/1965 | Toth | 30/169 |
| 3,341,945 | A | * | 9/1967 | Chase | 30/169 |
| 3,436,823 | A | * | 4/1969 | Lamb et al. | 30/169 |
| D232,344 | S | * | 8/1974 | Momcilovich | D32/48 |
| D235,965 | S | * | 7/1975 | Grinnell et al. | D32/49 |
| 4,202,093 | A | * | 5/1980 | Wallerstein | 30/169 |
| 4,542,553 | A | * | 9/1985 | Cary | 15/236.04 |
| 4,542,554 | A | * | 9/1985 | Wallerstein | 15/236.02 |
| 4,709,478 | A | * | 12/1987 | Cortelyou, Jr. | 30/169 |
| 4,759,092 | A | * | 7/1988 | Duddy | 15/236.08 |
| 4,890,351 | A | * | 1/1990 | Wilson | 15/236.1 |
| 5,208,984 | A | * | 5/1993 | Negus | 30/169 |
| D381,483 | S | * | 7/1997 | Hartman | D32/48 |
| 5,720,071 | A | * | 2/1998 | Hall | 15/236.08 |
| 6,629,331 | B2 | * | 10/2003 | Panfili et al. | 15/236.06 |

FOREIGN PATENT DOCUMENTS

| | | | |
|---|---|---|---|
| CA | 599715 | * | 6/1960 |
| DE | 334604 | * | 3/1921 |
| EP | 003379 | * | 8/1979 |
| GB | 2277900 | * | 11/1994 |

* cited by examiner

*Primary Examiner*—Mark Spisich
(74) *Attorney, Agent, or Firm*—John R. Hoffman

(57) ABSTRACT

A grill scraper is provided for scraping the surface of a cooking grill or the like. The scraper includes an elongated frame defining a longitudinal axis which extends between a front head end of the frame and a rear handle end of the frame. A blade head is mounted at the head end of the frame for mounting a scraping blade thereon. A first handle is mounted at the handle end of the frame and extends downwardly therefrom. A second handle is mounted on the frame rearwardly of the head end but remote from the first handle.

28 Claims, 5 Drawing Sheets

GRILL SCRAPER

FIELD OF THE INVENTION

This invention generally relates to cooking utensils and, particularly, to a grill scraper for scraping the surface of a cooking grill or the like.

BACKGROUND OF THE INVENTION

In many food preparation establishments, heated platens or planar grills are used to cook a wide variety of food products ranging from flat pancakes to vegetables, eggs and all kinds of meat products. After a food item or items is cooked, the surface of the grill often must be cleaned, particularly if the next food item to be cooked is different from the previous item. In fact, in fast-food establishments, the grill surface is cleaned repeatedly because of the constant or rapid shifting from one food item to be prepared to another food item, ranging from hamburgers, bread products, eggs, bacon and a myriad of food products which are prepared on the flat heated grill.

A typical cleaning utensil for flat heated platens is a grill scraper which has a flat edge for scraping food debris from the flat heated surface of the grill. The grill scraper may have a permanent scraping edge, or it may be provided with removable or replaceable scraping blades. In any event, most grill scrapers heretofore have been either simple, inexpensive and not very efficient or effective utensils, or elaborate, expensive utensils which often are not applicable for fast food establishments. They often are not ergodynamically sound nor easy to use. If the scraping blades are replaceable, this is a cumbersome process, and the blades often are not very soundly held within the utensil. The present invention is directed to solving these problems by providing a simple, inexpensive but effective grill scraper, including a scraper which uses replaceable blades.

SUMMARY OF THE INVENTION

An object, therefore, of the invention is to provide a new and improved grill scraper for scraping the surface of a cooking grill or the like.

In the exemplary embodiment of the invention, the grill scraper includes an elongated frame defining a longitudinal axis which extends between a front head end of the frame and a rear handle end of the frame. A blade head is provided at the head end of the frame for mounting a scraping blade thereon. A first handle is provided at the handle end of the frame and extends downwardly away from the head end at an obtuse angle to the longitudinal axis. A second handle is provided on the frame immediately behind the head end thereof but remote from the first handle.

According to one aspect of the invention, a hand guard extends upwardly from the head end of the frame toward the second handle to protect an operator's hand while grasping the second handle. The hand guard has a narrow distal end for discouraging an operator from grasping the hand guard instead of the second handle. In one embodiment of the invention, the hand guard is mounted for pivotal movement between a blade locking position and a blade release position. In the locking position, the handle guard removably holds the scraping blade on the blade head, where by the hand guard performs a dual function of protecting an operator's hand as well as removably mounting the scraping blade. Detent means hold the hand guard in either of its blade locking and release positions.

According to other aspects of the invention, the blade head includes a splash guard at a rear edge thereof to direct food material scraped from the surface of the grill away from an operator's hand. The elongated frame of the grill scraper includes a forward, generally straight portion which extends rearwardly from the head end, a rearward, generally straight portion which extends forwardly from the handle end, and an intermediate offset portion between the forward and rearward portions and which elevates the rearward portion from the forward portion to maintain an operator's hand away from the grill surface while grasping the first handle. The first handle includes an enlarged distal end to prevent an operator's hand from sliding off the first handle. The second handle is in the form of a rounded knob.

According to still a further aspect of the invention, the elongated frame is narrow and generally planar in a vertical plane relative to the surface of the cooking grill when the grill scraper is being used. In one embodiment of the invention, the elongated frame is a wire form frame. In another embodiment of the invention, the elongated frame is fabricated of cast metal material, such as aluminum. Gusset means are provided between the blade head and the planar frame for rigidifying the blade head relative to the frame.

In one embodiment of the invention, the blade head includes a support plate on which the scraping blade is mounted. A clamping plate is positioned on top of the scraping blade, and clamping means are provided for biasing the clamping plate toward the support plate to clamp the scraping blade therebetween. The clamping means may include at least one screw member engaged with the clamping plate, extending through the scraping blade and being threaded onto the support plate. A shoulder is provided on the support plate against which a rear edge of the scraping blade can abut. Preferably, the shoulder extends at an angle to a front scraping edge of the scraping blade. Lost motion is provided between the clamping means and the scraping blade whereby the blade can bias against and along the angled shoulder during a scraping operation should the scraping means become loosened. Lastly, the clamping plate may include an integral splash guard portion at a rear edge thereof to direct food material scraped from the surface of the grill away from an operator's hand.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figures 1, 2, 3, 4, 5, 6:
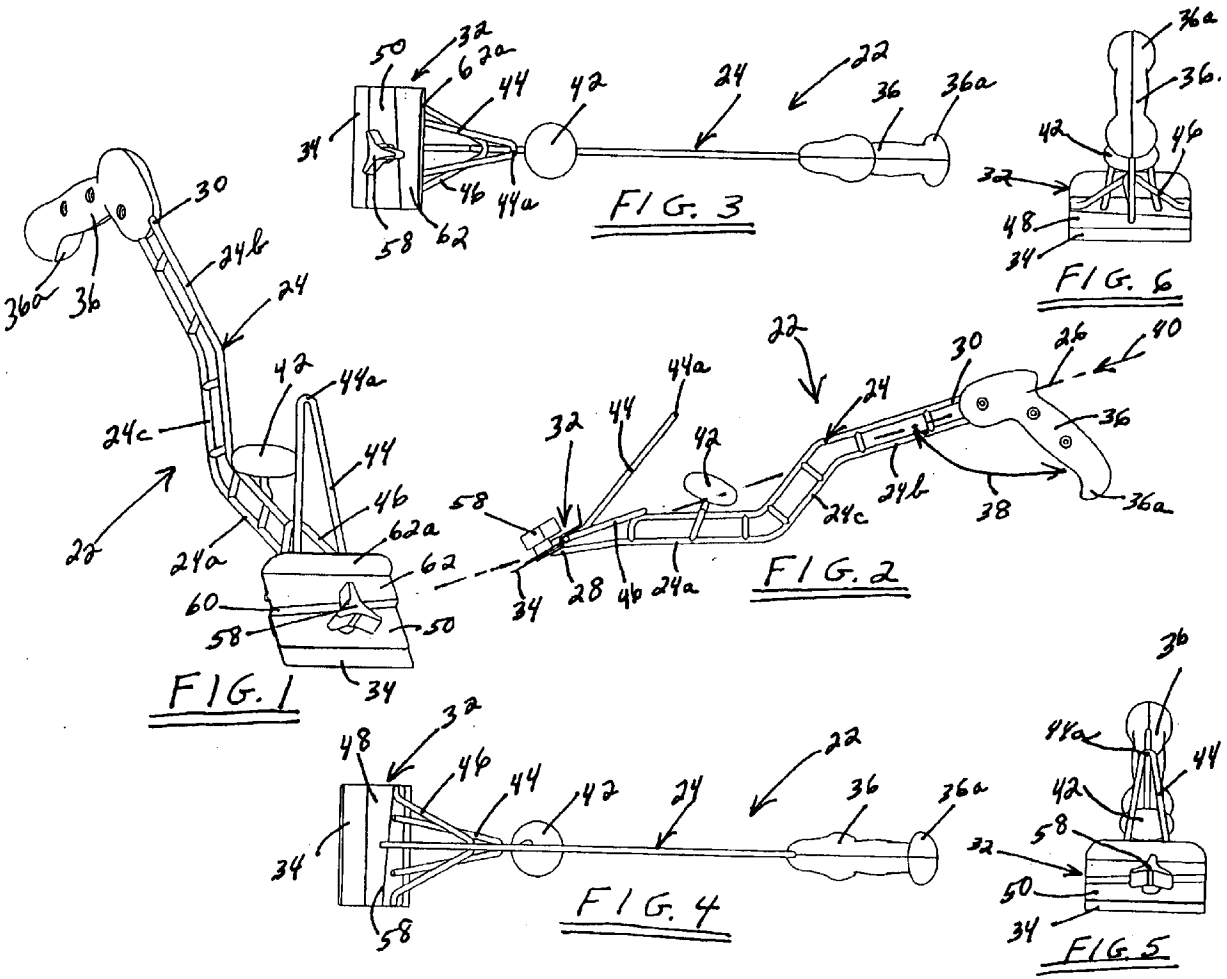
FIG. 1 is a perspective view of a griller scraper according to a first embodiment of the invention.
FIG. 2 is a side elevational view of the first embodiment.
FIG. 3 is a top plan view of the first embodiment.
FIG. 4 is a bottom plan view of the first embodiment.
FIG. 5 is a front elevational view of the first embodiment.
FIG. 6 is a rear elevational view of the first embodiment.

Referring to the drawings in greater detail, FIGS. 1–8 show a first embodiment of the invention. FIGS. 9–15D show a second embodiment of the invention. FIGS. 16–21 show a third embodiment of the invention. However, in all of the drawings, like reference numerals will be applied in all embodiments corresponding to like components both structurally and functionally common to all of the embodiments even though the general configurations may be slightly different. In addition, obvious descriptions in the second and third embodiments will not be repeated from the detailed description of the first embodiment.

With that understanding, referring first to FIGS. 1–6, the first embodiment of the invention is incorporated in a grill scraper, generally designated 22, which includes an elongated frame, generally designated 24, defining a longitudinal axis 26 which extends between a front head end 28 of the frame and a rear handle end 30 of the frame. A blade head, generally designated 32, is provided at head end 28 of frame 24 for mounting a scraping blade 34 thereon. Elongated frame 24 of the first embodiment is a metal wire form frame.

A first or rear handle 36 is mounted at handle end 30 of frame 24 and extends downwardly and away from head end 28 at an obtuse angle as indicated by double-headed, arched arrow 38. This orientation of rear handle 26 provides for excellent ergodynamic positioning of an operator's hand when force is applied to the grill scraper along longitudinal axis 26 in the direction of arrow 40.

A second or front handle 42 is mounted on frame 24 rearwardly of head end 28 of the frame but considerably remote from handle end 30 of the frame and rear handle 36. Therefore, the operator grasps front handle 42 of the grill scraper with his or her other hand. A hand guard 44 extends upwardly and rearwardly at an angle from head end 28 toward and above front handle 42 to protect the operator's hand while grasping the front handle. As best seen in FIGS. 1, 3 and 5, hand guard 44 is generally triangularly shaped to define a narrow distal end 44*a* to discourage the operator from grasping the hand guard instead of the front handle.

In the first embodiment of FIGS. 1–6, elongated frame 24 is a metal wire form frame as stated above. The frame is narrow in a vertical direction throughout its length as best seen in FIG. 2. The frame is generally planar in a vertical plane as best seen in FIGS. 3 and 4. In other words, the frame is planar in a vertical plane relative to the surface of the cooking grill when grill scraper 22 is being used. This provides for rigidity when pressure is applied by the operator downwardly onto the grill. A reinforcing wire triangular gusset 46 extends between blade head 32 and frame 24. As best seen in FIG. 2, the elongated frame includes a forward, generally straight portion 24*a* which extends rearwardly from head end 28 of the frame. A rearward, generally straight portion 24*b* extends forwardly from handle end 30 of the frame. An intermediate offset portion 24*c* extends at an angle between forward and rearward portions 24*a* and 24*b*, respectively, which, effectively, elevates rearward portion 24*b*, handle end 30 and rear handle 36 above the heated surface of the cooking grill to protect the operator's hand while grasping the rear handle and using the scraper. To that end, the bottom distal end 36*a* of rear handle 36 is enlarged to prevent the operator's hand from sliding off of the handle.

Figure 7A:
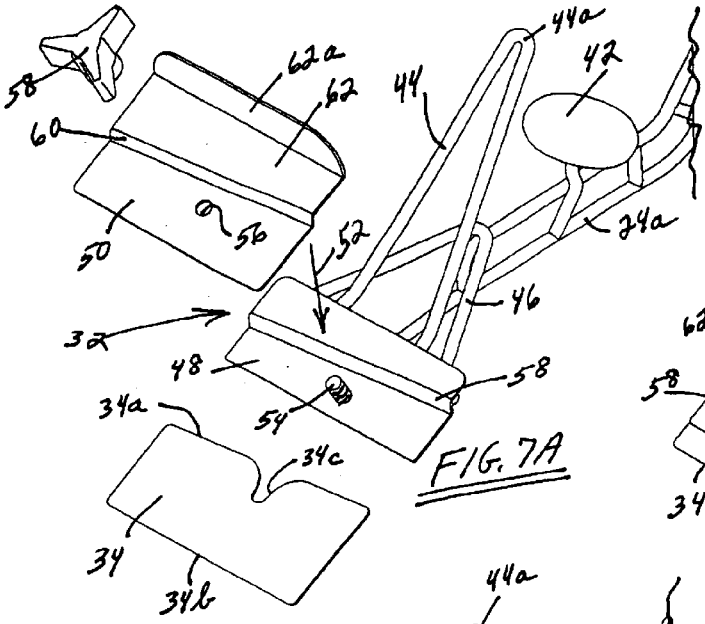
FIGS. 7A–7C are sequential views showing the mounting of a scraping blade on the blade head of the first embodiment.

Referring to FIG. 7A in view of FIGS. 1–6, blade head 32 includes a support plate 48 on which scraping blade 34 is mounted. A clamping plate 50 is positioned on top of the scraping blade and on top of support plate 48 in the direction of arrow 52. An externally threaded post 54 is fixed to and projects upwardly from support plate 48. The post extends through a hole 56 in clamping plate 50. A clamping means in the form of a hand-manipulatable nut 58 is threadable onto post 54. Support plate 48 has an angled shoulder 58, and clamping plate 50 has a complementary angled shoulder 60. Scraping blade 34 has a rear angled edge 34*a* and a forward scraping edge 34*b*. An outwardly flared notch 34*c* is formed in rear edge 34*a* of the blade.

Figure 7C:
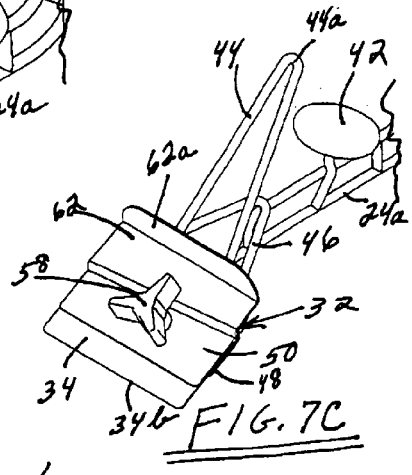
Figure 7B:
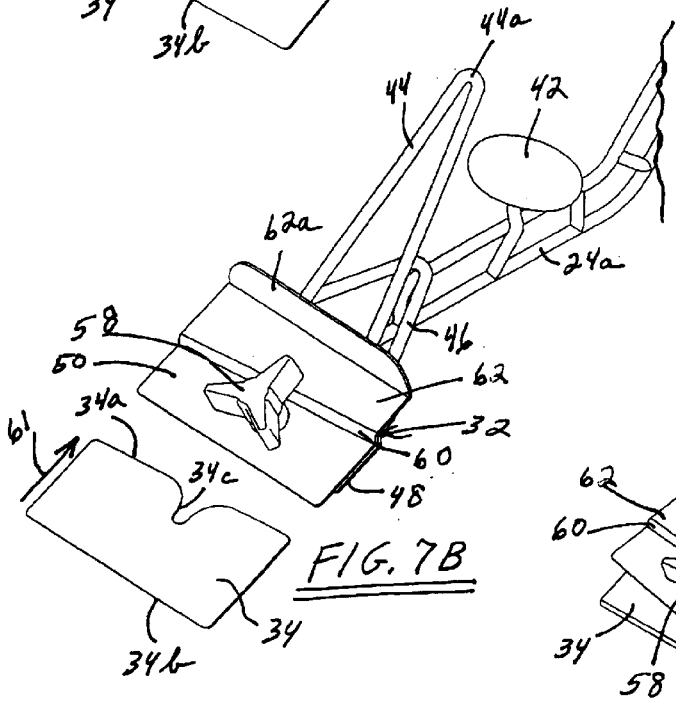

FIG. 7B shows clamping plate 50 properly mounted on support plate 48 with nut 58 threaded onto post 54 (FIG. 7A) and with angle shoulder 60 of the clamping plate nested against angled shoulder 58 of the support plate. With the clamping plate slightly loose, scraping blade 34 is inserted in the direction of arrow 61 between support plate 48 and clamping plate 50, and with flared notch 34*c* of the scraping blade embracing post 54.

FIG. 7C shows scraping blade 34 in its fully seated position with rear angled edge 34*a* abutting against angled shoulder 58 of support plate 48. Nut 58 then can be threaded tightly onto post 54 to bias clamping plate 50 against the scraping blade and to rigidly clamp the blade between the clamping plate and support plate 48.

Figure 8:
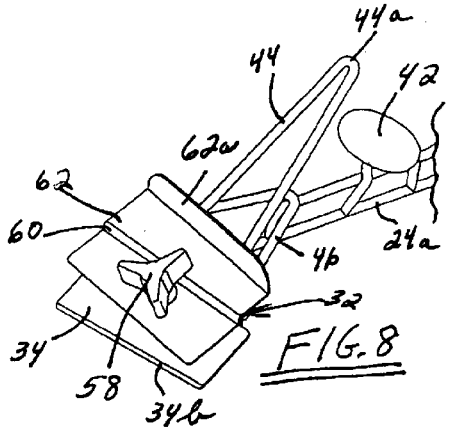
FIG. 8 is a perspective view of an improper mounting of the scraping blade in the first embodiment.
Figures 9, 10, 11, 12, 13, 14:
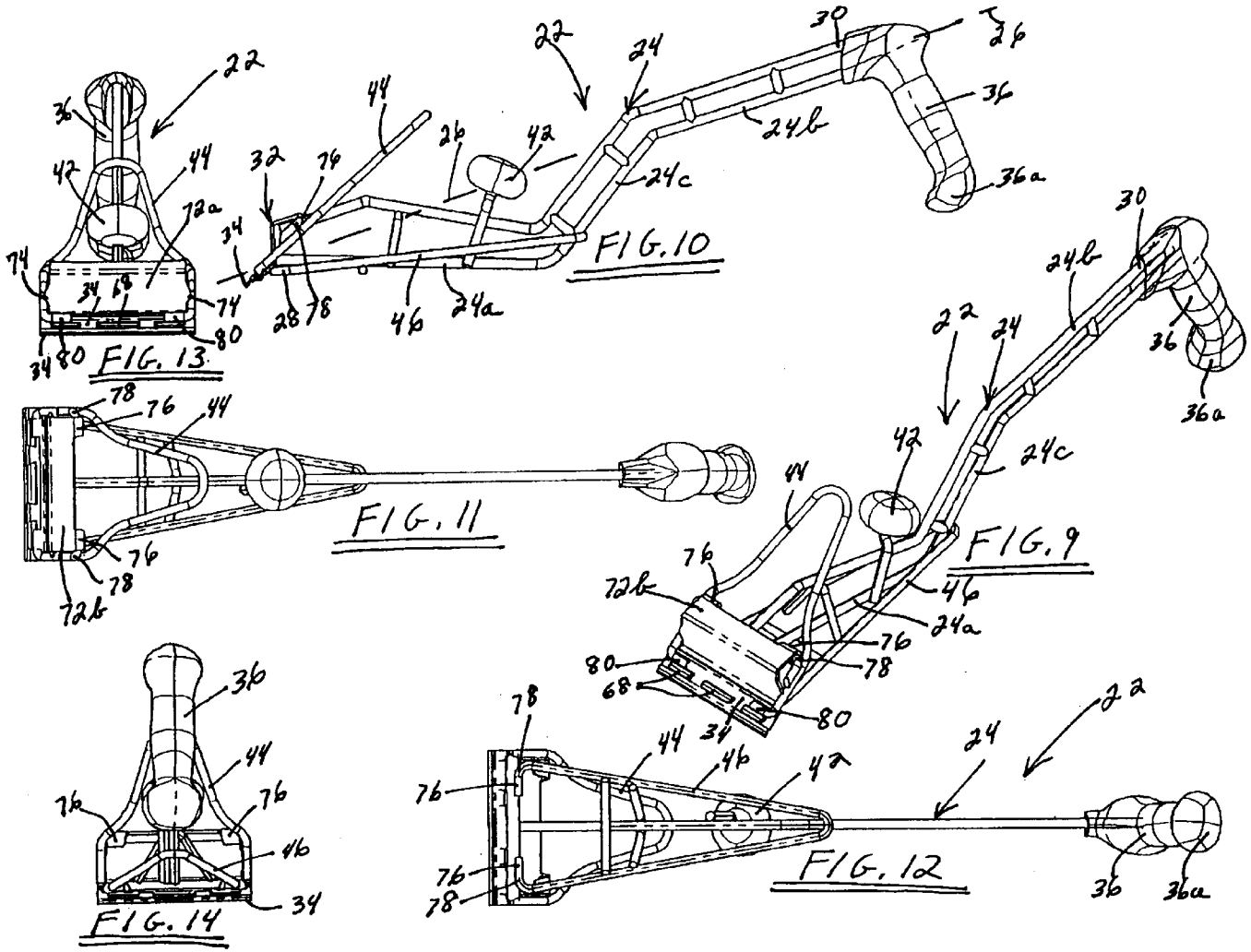
FIG. 9 is a perspective view of a grill scraper according to a second embodiment of the invention.
FIG. 10 is a side elevational of the second embodiment.
FIG. 11 is a top plan view of the second embodiment.
FIG. 12 is a bottom plan view of the second embodiment.
FIG. 13 is a front elevational view of the second embodiment.
FIG. 14 is a rear elevational view of the second embodiment.

Referring to FIG. 8, even if scraping plate 34 is inserted in a skewed orientation into blade head 32 as shown, angled rear edge 34*a* of the blade tends to readily move against angled shoulder 58 of support plate 48. In addition, even if some loosening occurs between the support and clamping plates, flared notch 34*c* in the blade provides for lost motion of the blade whereby the blade is biased against and along shoulder 58 during an actual scraping operation as post 54 seats into the bottom of notch 34*c*. Finally, clamping plate 50 has a splash guard portion 62, including an upwardly turned lip 62*a* to direct material scraped from the surface of the grill away from the operator and the operator's hand while grasping front handle 42.

The second embodiment of FIGS. 9–15D is similar, if not identical, to the first embodiment of FIGS. 1–8, except for the configuration of blade head 32 and the functioning of hand guard 44. In particular, blade head 32 includes a support plate 66 which may be seen best in FIG. 15A. The support plate includes three forwardly projecting lips 68 which extend into three elongated slots 70 in scraping blade 34. Lips 68 are curled or convex in configuration when looking downwardly thereon. An L-shaped flange 72 is integral with support plate 66 and projects upwardly from a rear edge thereof. The L-shaped flange defines a vertical flange portion 72*a* and a horizontal flange portion 72*b*. For purposes described hereinafter, a pair of detents 74 project outwardly from opposite side edges of vertical flange portion 72*a*. A pair of sockets 76 are formed at the rear corner edges of horizontal flange portion 72*b* as best seen in FIGS. 9–12.

Hand guard 44 of the second embodiment of FIGS. 9–15D is a unique structure in that it performs a dual function of protecting an operator's hand while grasping front handle 42 as well as removably locking scraping blade 34 within blade head 32. More particularly, hand guard 44 includes a pair of pivot posts 78 which extend into sockets 76 of horizontal flange portion 72*b* as best seen in FIGS. 9–12. This pivotally mounts hand guard 44 for pivotal movement on frame 24 between a blade locking position and blade release position, as described hereinafter. To that end, as best seen in FIGS. 9, 13 and 15A–15D, hand guard 44 has a pair of inwardly turned clamping fingers 80 which form a clamping means for clamping scraping blade 34 to support plate 66 in the locking position of hand guard 44, as described below.

Figure 15A:
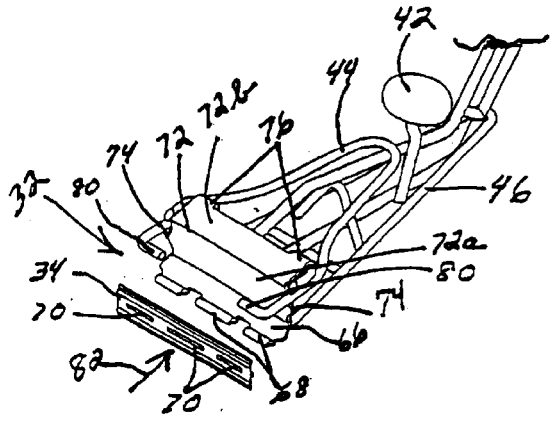
FIGS. 15A–15D are sequential views of mounting a scraping blade onto the blade head of the second embodiment.
Figure 15B:
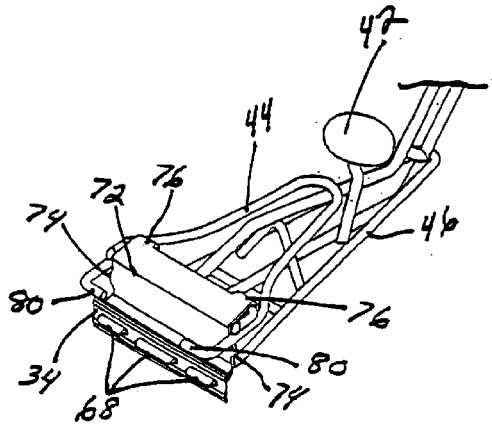
Figure 15C:
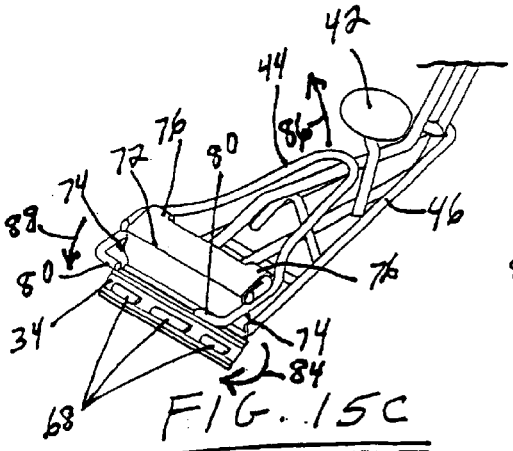
Figure 15D:
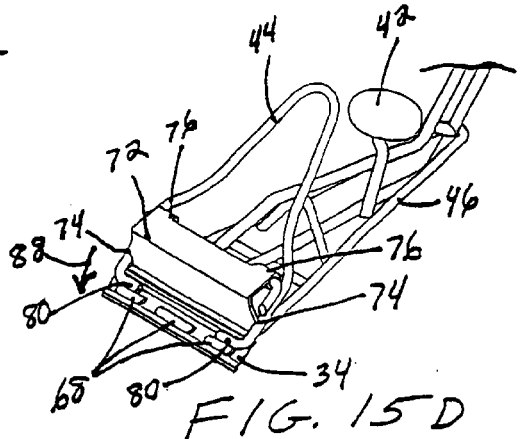
Figure 18:
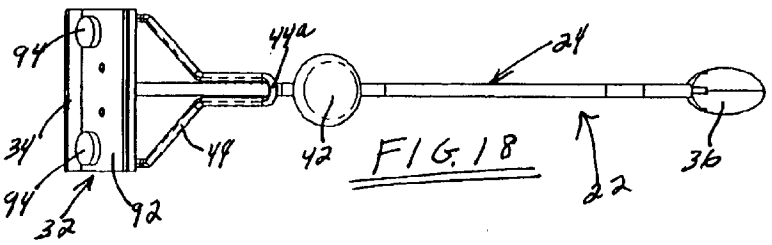
FIG. 18 is a top plan view of the third embodiment.
Figure 16:
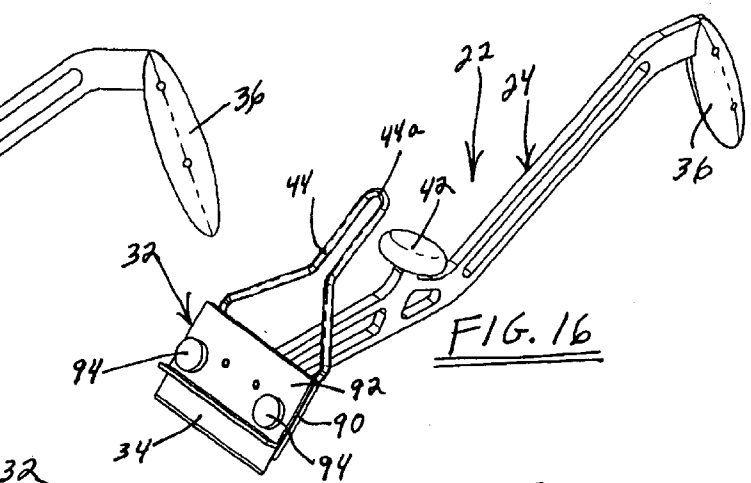
FIG. 16 is a perspective view of a grill scraper according to a third embodiment of the invention.
Figure 19:
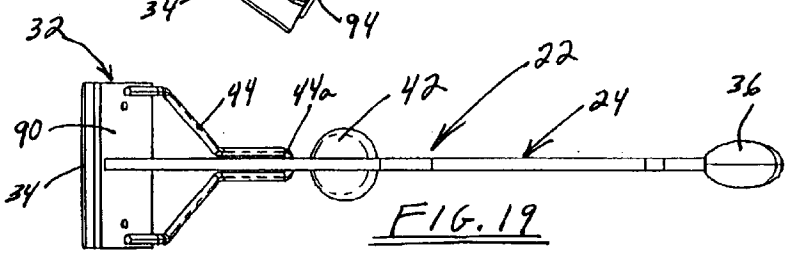
FIG. 19 is a bottom plan view of the third embodiment.
Figure 17:
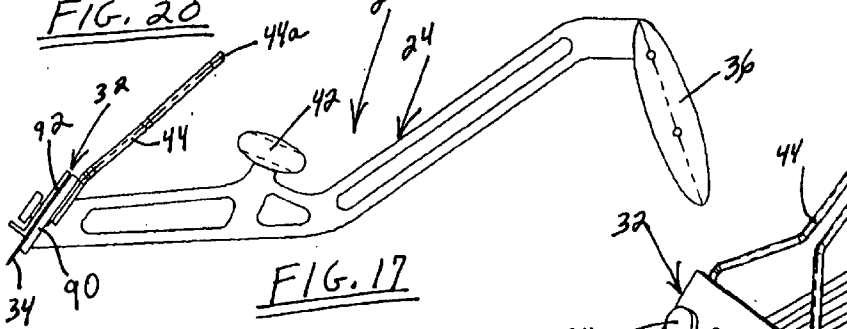
FIG. 17 is a side elevational view of the third embodiment.
Figure 20:
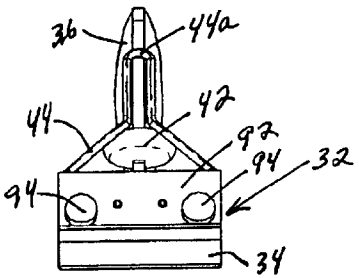
FIG. 20 is a front elevational view of the third embodiment.
Figure 21:
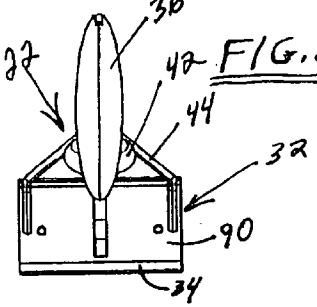
FIG. 21 is a rear elevational view of the third embodiment.

More particularly, referring to FIGS. 15A–15D, the mounting and clamping of scraping blade 34 now will be described. As explained above, FIG. 15A shows blade 34 with three elongated slots 70, and support plate 66 has three forwardly projecting curved lips 68. The blade is assembled to blade head 32 in the direction of arrow 82 (FIG. 15A) until lips 68 project through slots 70 in the blade as seen in FIG. 15B. Detents 74 hold hand guard 44 in a downward "release" position with clamping fingers 80 elevated above support plate 66 and blade 34. The blade then is rotated about lips 68 in the direction of arrow 84 (FIG. 15C) to a generally horizontal position, with clamping fingers 80 of hand guard 44 still held above the blade by detents 74. Hand guard 44 then is lifted upwardly in the direction of arrow 86 to drive clamping fingers 80 downwardly in the direction of arrows 88 to clamp blade 34 against support plate 66. During this movement of hand guard 44 from its release position shown in FIGS. 15A–15C, the sides of the hand guard snap over detents 74 to the locking position of the hand guard shown in FIG. 15D. The hand guard is fabricated as a wire form of spring metal material so that the hand guard is spring loaded and is held securely in the blade locking position as the hand guard is pivoted thereto about pivot posts 78.

While the first embodiment of FIGS. 1–8 and the second embodiment of FIGS. 9–15D are fabricated with frame 24 of a metal wire form, the third embodiment of FIGS. 16–21 is fabricated with an elongated frame 24 that is of cast metal material, such as aluminum. Otherwise, the frame components and the general configuration thereof are similar if not identical to the frame of the first two embodiments.

In the third embodiment of FIGS. 16–21, blade head 32 is a simple construction involving a support plate 90 and a clamping plate 92, with a pair of manually manipulatable screw members 94 to clamp scraping blade 34 between the support plate and the clamping plate. While frame 24 is of cast material, hand guard 44 is of wire form. In addition, with the cast metal frame of the third embodiment, the gussets 46 of the first two embodiments can be eliminated. Otherwise, the grill scraper of the third embodiment functions the same as and is ergodynamically efficient as in the first two embodiments.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A grill scraper for scraping the surface of a cooking grill or the like, comprising:

an elongated frame defining a longitudinal axis which extends between a front head end of the frame and a rear handle end of the frame;

a blade head at the head end of the frame for mounting a scraping blade thereon;

a first handle at the handle end of the frame;

a second handle on the frame near the head end thereof remote from the first handle; and a hand guard extending upwardly from the head end of the frame toward the second handle to protect an operator's hand while grasping the second handle, said hand guard having a narrow distal end for discouraging an operator from grasping the hand guard instead of the second handle.

2. The grill scraper of claim 1 wherein said hand guard includes means for removably mounting the scraping blade on the blade head whereby the hand guard performs a dual function of protecting an operator's hand as well as removably mounting the scraping blade.

3. The grill scraper of claim 2 wherein said hand guard is movably mounted on the frame for movement between a blade locking position and a blade release position.

4. The grill scraper of claim 3, including means for pivotally mounting the hand guard for pivotal movement between said positions.

5. The grill scraper of claim 4, including detent means operatively associated with the hand guard for holding the hand guard in either of said blade locking and release positions.

6. The grill scraper of claim 3 wherein said blade head includes a support plate on which the scraping blade is supported, and the hand guard includes clamping means for clamping the blade to the support plate in the locking position of the hand guard.

7. The grill scraper of claim 1 wherein said first handle includes an enlarged distal end to prevent an operator's hand from sliding off the first handle.

8. The grill scraper of claim 1 wherein said second handle is in the form of a rounded knob.

9. The grill scraper of claim 1 wherein said elongated frame is narrow and generally planar in a vertical plane relative to the surface of the cooking grill when the grill scraper is being used.

10. The grill scraper of claim 9 wherein said elongated frame is a wire form frame.

11. The grill scraper of claim 9 wherein said elongated frame is fabricated of cast metal material.

12. A grill scraper for scraping the surface of a cooking grill or the like, comprising:

an elongated frame defining a longitudinal axis which extends between a front head end of the frame and a rear handle end of the frame;

a blade head at the head end of the frame for mounting a scraping blade thereon;

a first handle at the handle end of the frame;

a second handle on the frame near the head end thereof remote from the first handle; and a hand guard extending upwardly from the head end of the frame toward the second handle to protect an operator's hand while grasping the second handle, said hand guard being generally triangularly shaped between a wide end adjacent the blade head and said narrow distal end for discouraging an operator from grasping the hand guard instead of the second handle.

13. The grill scraper of claim 12 wherein said hand guard includes means for removably mounting the scraping blade on the blade head whereby the hand guard performs a dual function of protecting an operator's hand as well as removably mounting the scraping blade.

14. The grill scraper of claim 13 wherein said hand guard is movably mounted on the frame for movement between a blade locking position and a blade release position.

15. The grill scraper of claim 14, including detent means operatively associated with the hand guard for holding the hand guard in either of said blade locking and release positions.

16. The grill scraper of claim 14 wherein said blade head includes a support plate on which the scraping blade is supported, and the hand guard includes clamping means for clamping the blade to the support plate in the locking position of the hand guard.

17. The grill scraper of claim 12 wherein said blade head includes a splash guard at a rear edge thereof to direct material scraped from the surface of the grill away from an operator's hand.

18. A grill scraper for scraping the surface of a cooking grill or the like, comprising:

an elongated frame defining a longitudinal axis which extends between a front head end of the frame and a rear handle end of the frame, the elongated frame including a forward generally straight portion which extends rearwardly from the head end of the frame, a rearward generally straight portion which extends forwardly from the handle end of the frame, and an intermediate offset portion between the forward and rearward portions and which elevates the rearward portion from the forward portion to protect an operator's hand while grasping the first handle;

a blade head at the head end of the frame for mounting a scraping blade thereon;

a first handle at the handle end of the frame; and a second handle on the frame near the head end thereof remote from the first handle.

19. The grill scraper of claim 18 wherein said elongated frame is narrow and generally planar in a vertical plane relative to the surface of the cooking grill when the grill scraper is being used.

20. The grill scraper of claim 19 said elongated frame is a wire form frame.

21. The grill scraper of claim 19 wherein said elongated frame is fabricated of cast metal material.

22. The grill scraper of claim 19, including gusset means extending between the blade head and the planar frame for rigidifying the blade head relative to the frame.

23. A grill scraper for scraping the surface of a cooking grill or the like, comprising:

an elongated frame having a front head end;

a handle remote from the front head end of the frame; and a blade head at the head end of the frame for mounting a scraping blade thereon, and the blade head including a support plate on which the scraping blade is mounted, a clamping plate for positioning on top of the scraping blade, clamping means for biasing the clamping plate toward the support plate to clamp the scraping blade therebetween, said support plate including a shoulder against which a rear edge of the scraping blade can abut, and lost motion means between said clamping means and the scraping blade whereby the blade can bias against and along said shoulder during a scraping operation should the clamping means become loosened.

24. The grill scraper of claim 23 wherein said shoulder extends at an angle to a front scraping edge of the scraping blade.

25. The grill scraper of claim 23 wherein said clamping plate includes a splash guard at a rear edge thereof to direct material scraped from the surface of the grill away from an operator's hand.

26. A grill scraper for scraping the surface of a cooking grill or the like, comprising:

an elongated frame defining a longitudinal axis which extends between a front head end of the frame and a rear handle end of the frame;

a blade head at the head end of the frame for mounting a scraping blade thereon;

a first handle at the handle end of the frame and extending downwardly away from the head end at an obtuse angle to said longitudinal axis;

a second handle on the frame near the head end thereof remote from the first handle; and said elongated frame including a forward generally straight portion which extends rearwardly from the head end of the frame, a rearward generally straight portion which extends forwardly from the handle end of the frame, and an intermediate offset portion between the forward and rearward portions and which elevates the rearward portion from the forward portion to protect an operator's hand white grasping the first handle.

27. A grill scraper for scraping the surface of a cooking grill or the like, comprising:

an elongated frame defining a longitudinal axis which extends between a front head end of the frame and a rear handle end of the frame;

a blade head at the head end of the frame for mounting a scraping blade thereon;

a first handle at the handle end of the frame and extending downwardly away from the head end at an obtuse angle to said longitudinal axis;

a second handle on the frame near the head end thereof remote from the first handle; and said blade head including a support plate on which the scraping blade is mounted, a clamping plate for positioning on top of the scraping blade, and clamping means for biasing the clamping plate toward the support plate to clamp the scraping blade therebetween, said support plate including a shoulder against which a rear edge of the scraping blade can abut, and lost motion means between said clamping means and the scraping blade whereby the blade can bias against and along said shoulder during a scraping operation should the clamping means become loosened.

28. The grill scraper of claim 27 wherein said shoulder extends at an angle to a front scraping edge of the scraping blade.

* * * * *